US010066564B2

(12) United States Patent
Song et al.

(10) Patent No.: US 10,066,564 B2
(45) Date of Patent: Sep. 4, 2018

(54) HUMIDITY DETERMINATION AND COMPENSATION SYSTEMS AND METHODS USING AN INTAKE OXYGEN SENSOR

(75) Inventors: B. Jerry Song, Novi, MI (US); Ethan E. Bayer, Lake Orion, MI (US); Ben W. Moscherosch, Waterford, MI (US); Calvin K. Koch, Bloomfield Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 1695 days.

(21) Appl. No.: 13/490,885

(22) Filed: Jun. 7, 2012

(65) Prior Publication Data

US 2013/0332050 A1 Dec. 12, 2013

(51) Int. Cl.
*F02D 41/00* (2006.01)
*F02D 41/14* (2006.01)

(52) U.S. Cl.
CPC .... *F02D 41/144* (2013.01); *F02D 2041/1472* (2013.01); *F02D 2200/0402* (2013.01); *F02D 2200/0406* (2013.01); *F02D 2200/0418* (2013.01)

(58) Field of Classification Search
CPC ..... F02D 41/144; F02D 41/3035; F02D 2200/0406; F02D 2041/001; F02B 1/12
USPC ..... 701/104
See application file for complete search history.

(56) References Cited

U.S. PATENT DOCUMENTS 4,081,725 A 3/1978 Schmidt et al.
4,404,946 A 9/1983 Hoard et al.
4,790,286 A 12/1988 Nishida et al.
4,836,174 A 6/1989 Chujo et al.
4,905,654 A 3/1990 Katsuno et al.
4,942,860 A 7/1990 Chujo et al.
4,990,235 A 2/1991 Chujo
5,034,112 A 7/1991 Murase et al.
5,190,017 A 3/1993 Cullen et al.
5,205,260 A 4/1993 Takahashi et al.
5,207,093 A 5/1993 Maeda
(Continued)

FOREIGN PATENT DOCUMENTS

CN 201177563 Y 1/2009
CN 101932816 A 12/2010
(Continued)

OTHER PUBLICATIONS

U.S. Appl. No. 13/786,944, filed Mar. 6, 2013, Naik et al.
(Continued)

*Primary Examiner* — Hai Huynh
*Assistant Examiner* — Gonzalo Laguarda

(57) ABSTRACT

An engine control system for a vehicle includes an oxygen mass flow rate module, an oxygen per cylinder module, and a fuel control module. The oxygen mass flow rate module generates a mass flow rate of oxygen flowing into an engine based on a mass air flow rate (MAF) into the engine and a percentage of oxygen by volume measured using an intake oxygen (IO) sensor in an intake system. The oxygen per cylinder module generates a mass of oxygen for a combustion event of a cylinder of the engine based on the mass flow rate of oxygen flowing into the engine. The fuel control module controls fueling to the cylinder for the combustion event based on the mass of oxygen.

20 Claims, 6 Drawing Sheets

(56) References Cited

U.S. PATENT DOCUMENTS 5,323,635 A 6/1994 Ueno et al.
5,465,617 A 11/1995 Dudek et al.
5,465,619 A 11/1995 Dudek et al.
5,499,617 A 3/1996 Kitajima et al.
5,540,091 A 7/1996 Nakagawa
5,617,337 A 4/1997 Eidler et al.
5,639,961 A 6/1997 Lautenschutz
5,685,284 A 11/1997 Nakamichi
6,000,385 A 12/1999 Fukuma
6,029,451 A 2/2000 Gartner
6,128,902 A 10/2000 Kolmanovsky et al.
6,164,270 A 12/2000 Bidner
6,178,943 B1 1/2001 Taga et al.
6,240,365 B1 5/2001 Bunn
6,309,534 B1 10/2001 Fray et al.
6,311,679 B1 11/2001 Druzhinina
6,367,462 B1 4/2002 McKay et al.
6,405,106 B1 6/2002 Sheth et al.
6,505,603 B1 1/2003 Schray et al.
6,516,656 B1 2/2003 Jetter et al.
6,575,148 B1 6/2003 Bhargava et al.
6,581,370 B2 6/2003 Sato et al.
6,581,447 B1 6/2003 Strohrmann et al.
6,609,493 B2 8/2003 Yamaguchi et al.
6,711,892 B2 3/2004 Tamura et al.
6,732,031 B1 5/2004 Lightner et al.
6,738,697 B2 5/2004 Breed
6,739,177 B2 5/2004 Sato et al.
6,772,586 B2 8/2004 Miyahara et al.
6,802,302 B1 10/2004 Li et al.
6,817,197 B1 11/2004 Padfield
6,820,600 B1 11/2004 Sisken et al.
7,016,779 B2 3/2006 Bowyer
7,104,259 B2 9/2006 Terada
7,155,332 B2 12/2006 Yamada et al.
7,181,335 B2 2/2007 Barba et al.
7,181,908 B2 2/2007 Naik
7,195,009 B2 3/2007 Cullen
7,254,477 B1 8/2007 Banks
7,261,098 B2 8/2007 Vigild et al.
7,267,117 B2 9/2007 Tonetti et al.
7,318,409 B2 1/2008 Cullen
7,398,775 B2 7/2008 Cullen
7,400,967 B2 7/2008 Ueno et al.
7,409,275 B2 8/2008 Sakurai et al.
7,463,960 B2 12/2008 Thiel et al.
7,474,954 B1 1/2009 Zagone
7,526,950 B2 5/2009 Van Nieuwstadt et al.
7,532,963 B1 5/2009 Lowrey et al.
7,565,892 B1 7/2009 Cleary et al.
7,565,901 B2 7/2009 Furuta et al.
7,620,490 B2 11/2009 Matsunaga
7,650,211 B2 1/2010 Wang et al.
7,654,253 B2 2/2010 Cullen
7,715,976 B1 5/2010 Xiao et al.
7,974,749 B2 7/2011 Zettel et al.
8,042,528 B2 10/2011 Gates et al.
8,103,428 B2 1/2012 Russ et al.
8,127,816 B2 3/2012 Gnan
8,315,759 B2 11/2012 Bauerle
8,469,010 B2 6/2013 Inoue
8,521,354 B2 * 8/2013 Sasaki ..... 701/29.1
8,543,317 B2 9/2013 Pasero et al.
8,733,081 B2 5/2014 Miyashita
9,080,528 B2 7/2015 Aoyagi
9,228,524 B2 1/2016 Song
2001/0032637 A1 10/2001 Grieve et al.
2002/0029768 A1 3/2002 Matsubara et al.
2002/0066442 A1 6/2002 Muller et al.
2002/0139360 A1 10/2002 Sato et al.
2003/0047172 A1 3/2003 Kim
2003/0106367 A1 6/2003 Osaki et al.
2003/0115854 A1 6/2003 Tamura et al.
2003/0159521 A1 8/2003 Sarholz et al.
2003/0216856 A1 11/2003 Jacobson
2004/0061290 A1 * 4/2004 Gray, Jr. ..... 277/411
2004/0079332 A1 4/2004 Kotwicki
2004/0230345 A1 11/2004 Tzamaloukas
2005/0072411 A1 4/2005 Cullen
2005/0131620 A1 6/2005 Bowyer
2005/0139193 A1 6/2005 Kobayashi et al.
2005/0161029 A1 7/2005 Ishikawa
2005/0274369 A1 12/2005 Tonetti et al.
2006/0048760 A1 3/2006 Matsunaga et al.
2006/0064228 A1 * 3/2006 Huang ..... 701/104
2006/0213490 A1 9/2006 Vigild et al.
2007/0005609 A1 1/2007 Breed
2007/0021901 A1 1/2007 Yamaguchi et al.
2007/0062499 A1 3/2007 Miyasako et al.
2007/0100519 A1 5/2007 Engel
2007/0174003 A1 7/2007 Ueno et al.
2007/0181111 A1 8/2007 Cullen
2007/0192018 A1 8/2007 Gibson et al.
2008/0098734 A1 5/2008 Olsson
2008/0178836 A1 7/2008 Yamashita et al.
2008/0178853 A1 7/2008 Yamaoka et al.
2008/0189009 A1 8/2008 Wang et al.
2008/0270012 A1 10/2008 Cullen
2008/0316006 A1 12/2008 Bauman et al.
2009/0038308 A1 2/2009 Nagae
2009/0132153 A1 5/2009 Shutty et al.
2009/0198431 A1 8/2009 Cleary et al.
2009/0254245 A1 10/2009 Bauerle
2010/0012100 A1 1/2010 Asano et al.
2010/0042284 A1 2/2010 Sasaki
2010/0077990 A1 4/2010 Shishime et al.
2010/0185379 A1 7/2010 Burkhardt et al.
2010/0199665 A1 8/2010 Kapus
2010/0224174 A1 9/2010 Tabata
2010/0263627 A1 10/2010 Whitney et al.
2010/0307140 A1 12/2010 Viola et al.
2010/0332075 A1 12/2010 Clarke et al.
2011/0011378 A1 1/2011 Nakamura
2011/0023847 A1 2/2011 Gates et al.
2011/0054762 A1 3/2011 Nakayama et al.
2011/0072793 A1 * 3/2011 Bidner et al. ..... 60/285
2011/0077838 A1 3/2011 Osburn et al.
2011/0166767 A1 7/2011 Kurtz et al.
2011/0172897 A1 7/2011 Tsuzuki et al.
2011/0191010 A1 8/2011 Russ et al.
2011/0209685 A1 9/2011 Shane et al.
2011/0282539 A1 11/2011 Inoue
2011/0315114 A1 12/2011 Hammond et al.
2012/0016571 A1 1/2012 Nada
2012/0046854 A1 2/2012 Sangkyu et al.
2012/0053821 A1 3/2012 Wolfe et al.
2012/0116648 A1 5/2012 Russ et al.
2012/0227714 A1 9/2012 Surnilla et al.
2012/0227719 A1 9/2012 Surnilla et al.
2012/0247439 A1 10/2012 Ramappan et al.
2012/0303346 A1 11/2012 Takezoe et al.
2013/0054122 A1 * 2/2013 Aoyagi ..... 701/104
2013/0073179 A1 3/2013 Song et al.
2013/0199177 A1 8/2013 Holberg et al.
2013/0213352 A1 8/2013 Kumar et al.
2013/0226435 A1 8/2013 Wasberg et al.
2013/0238218 A1 9/2013 Wiggins et al.
2013/0253798 A1 9/2013 Ramappan et al.
2013/0253802 A1 9/2013 Miyamoto et al.
2013/0268176 A1 10/2013 Song et al.
2014/0149015 A1 5/2014 Pursifull
2014/0257673 A1 9/2014 Naik et al.

(56) References Cited

U.S. PATENT DOCUMENTS

| | | | |
|---|---|---|---|
| 2014/0288804 | A1 | 9/2014 | Pursifull |
| 2015/0051811 | A1 | 2/2015 | Song et al. |
| 2015/0075503 | A1 | 3/2015 | Surnilla et al. |
| 2015/0101327 | A1 | 4/2015 | Clark et al. |

FOREIGN PATENT DOCUMENTS

| | | | |
|---|---|---|---|
| CN | 101988432 | A | 3/2011 |
| CN | 102003311 | A | 4/2011 |
| CN | 102235271 | A | 11/2011 |
| CN | 102297031 | A | 12/2011 |
| CN | 202117781 | U | 1/2012 |
| CN | 102678392 | A | 9/2012 |
| CN | 202510230 | U | 10/2012 |
| CN | 203394658 | U | 1/2014 |
| DE | 102005044266 | A1 | 3/2007 |
| DE | 102009046120 | | 5/2011 |
| EP | 1481295 | A1 | 12/2004 |
| JP | 63140856 | A | 6/1988 |
| JP | 63159664 | A | 7/1988 |
| JP | 405118246 | | 5/1993 |
| JP | 09042066 | | 2/1997 |
| JP | 2003148258 | A | 5/2003 |
| JP | 2006029084 | A | 2/2006 |
| JP | 2008087480 | A | 4/2008 |
| JP | 2008248888 | A | 10/2008 |
| JP | 2009243283 | A | 10/2009 |
| JP | 2009287491 | A | 12/2009 |
| JP | 2010203281 | A | 9/2010 |
| WO | WO-2003065135 | A1 | 7/2003 |
| WO | WO-2004027244 | A1 | 4/2004 |
| WO | WO-2009118605 | A1 | 10/2009 |
| WO | WO-2011145223 | A1 | 11/2011 |

OTHER PUBLICATIONS

U.S. Appl. No. 13/967,660, filed Aug. 15, 2013, Song et al.
U.S. Appl. No. 13/967,591, filed Aug. 15, 2013, Song et al.
U.S. Appl. No. 13/238,460, filed Sep. 21, 2011, Song et al.
U.S. Appl. No. 13/408,577, filed Feb. 29, 2012, Wasberg et al.
U.S. Appl. No. 13/425,725, filed Mar. 21, 2012, Ramappan et al.
U.S. Appl. No. 13/440,570, filed Apr. 5, 2012, Song et al.
U.S. Appl. No. 13/490,821, filed Jun. 7, 2012, Wiggins et al.
Bugbee, B. and Blonquist, M., "Absolute and Relative Gas Concentration: Understanding Oxygen in Air," Feb. 27, 2006, Apogee Instruments, pp. 1-9. <http://www.apogeeinstruments.com/content/o2s_correcting.pdf>.
Office Action dated Feb. 19, 2017, from the German Patent Office for German Patent Application No. 10 2013 204 699.5; 4 pages.
Office Action dated Mar. 22, 2017, from the German Patent Office for German Patent Application No. 10 2013 205 770.9; 4 pages.
SST Sensing Ltd, "Operating Principle and Construction of Zirconium Dioxide Oxygen Sensors," 2010, pp. 1-14.
Office Action dated Apr. 11, 2017, from the German Patent Office for German Patent Application No. 10 2013 203 142.2, 5 pages.
Office Action dated Jun. 2, 2015, from the Chinese Patent Office for Chinese Patent Application No. 201310225243.0; 17 pages.
Office Action dated Mar. 11, 2015, from the Chinese Patent Office for Chinese Patent Application No. 201310070831.1; 12 pages.
Office Action dated May 24, 2018, from the German Patent Office for German Patent Application No. 10 2013 209 781.6; 7 pages.

* cited by examiner

HUMIDITY DETERMINATION AND COMPENSATION SYSTEMS AND METHODS USING AN INTAKE OXYGEN SENSOR

CROSS-REFERENCE TO RELATED APPLICATIONS

This application is related to U.S. patent application Ser. No. 13/440,570 filed on Apr. 5, 2012, Ser. No. 13/425,723 filed on Mar. 21, 2012, and Ser. No. 13/490,821 filed on Jun. 7, 2012, which claims the benefit of U.S. Provisional Patent Application No. 61/607,078 filed on Mar. 6, 2012. The disclosures of the above applications are incorporated herein by reference in their entirety.

FIELD

The present application is relates to internal combustion engines and more particularly systems and methods for controlling an engine based on humidity.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Air is drawn into an engine through an intake manifold. A throttle valve controls airflow into the engine. The air mixes with fuel from one or more fuel injectors to form an air/fuel mixture. The air/fuel mixture is combusted within one or more Combustion of the air/fuel mixture produces torque and exhaust gas. Torque is generated via heat release and expansion during combustion of the air/fuel mixture. The engine transfers torque to a transmission via a crankshaft, and the transmission transfers torque to one or more wheels via a driveline. The exhaust gas is expelled from the cylinders to an exhaust system.

An engine control module (ECM) controls the torque output of the engine. The ECM may control the torque output of the engine based on driver inputs and/or other suitable inputs. The driver inputs may include, for example, accelerator pedal position, brake pedal position, and/or one or more other suitable driver inputs.

SUMMARY

An engine control system for a vehicle includes an oxygen mass flow rate module, an oxygen per cylinder module, and a fuel control module. The oxygen mass flow rate module generates a mass flow rate of oxygen flowing into an engine based on a mass air flow rate (MAF) into the engine and a percentage of oxygen by volume measured using an intake oxygen (IO) sensor in an intake system. The oxygen per cylinder module generates a mass of oxygen for a combustion event of a cylinder of the engine based on the mass flow rate of oxygen flowing into the engine. The fuel control module controls fueling to the cylinder for the combustion event based on the mass of oxygen.

An engine control method for a vehicle, includes: generating a mass flow rate of oxygen flowing into an engine based on a mass air flow rate (MAF) into the engine and a percentage of oxygen by volume measured using an intake oxygen (IO) sensor in an intake system; and generating a mass of oxygen for a combustion event of a cylinder of the engine based on the mass flow rate of oxygen flowing into the engine. The method further includes controlling fueling to the cylinder for the combustion event based on the mass of oxygen.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Air flows into an engine through an intake system of a vehicle. The air may include, for example, oxygen ($O_2$), nitrogen ($N_2$), and water vapor (humidity). An engine control module (ECM) controls operation of the engine. Humidity in the air flowing into the engine, however, may affect performance of the engine and may prevent the ECM from controlling the engine to achieve a desired engine torque output.

More specifically, lighter water vapor molecules in the air flowing into the engine displace heavier oxygen molecules, and the amount of oxygen within a cylinder during a combustion event affects combustion and performance. For example, engine torque output may decrease as the amount of oxygen decreases, and vice versa.

Ambient humidity could be measured using a humidity sensor. However, addition of a humidity sensor may increase vehicle cost. Accordingly, the vehicle of the present disclosure does not include a humidity sensor that measures humidity of ambient air flowing into the engine.

The ECM of the present disclosure may determine an amount (e.g., mass) of oxygen for a combustion event of the engine without measurements of a humidity sensor. The ECM may, for example, determine the mass of oxygen for a combustion event based on measurements from an intake oxygen (IO) sensor because the measurements of the IO sensor are affected by humidity. Additionally or alternatively, the ECM may determine ambient humidity based on measurements from the IO sensor.

Figure 1A:
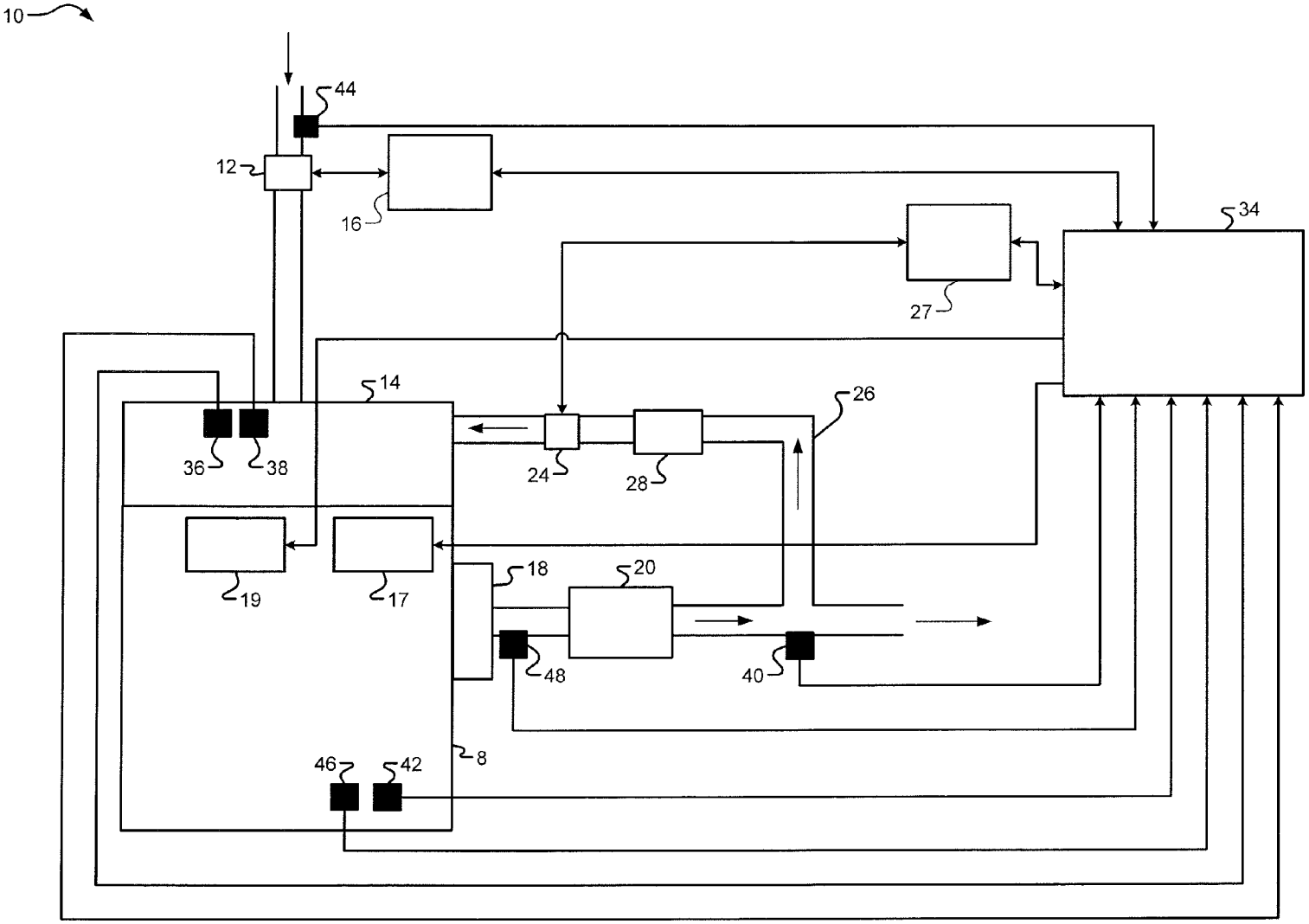
FIGS. 1A and 1B are functional block diagrams of example engine systems.
Figure 1B:
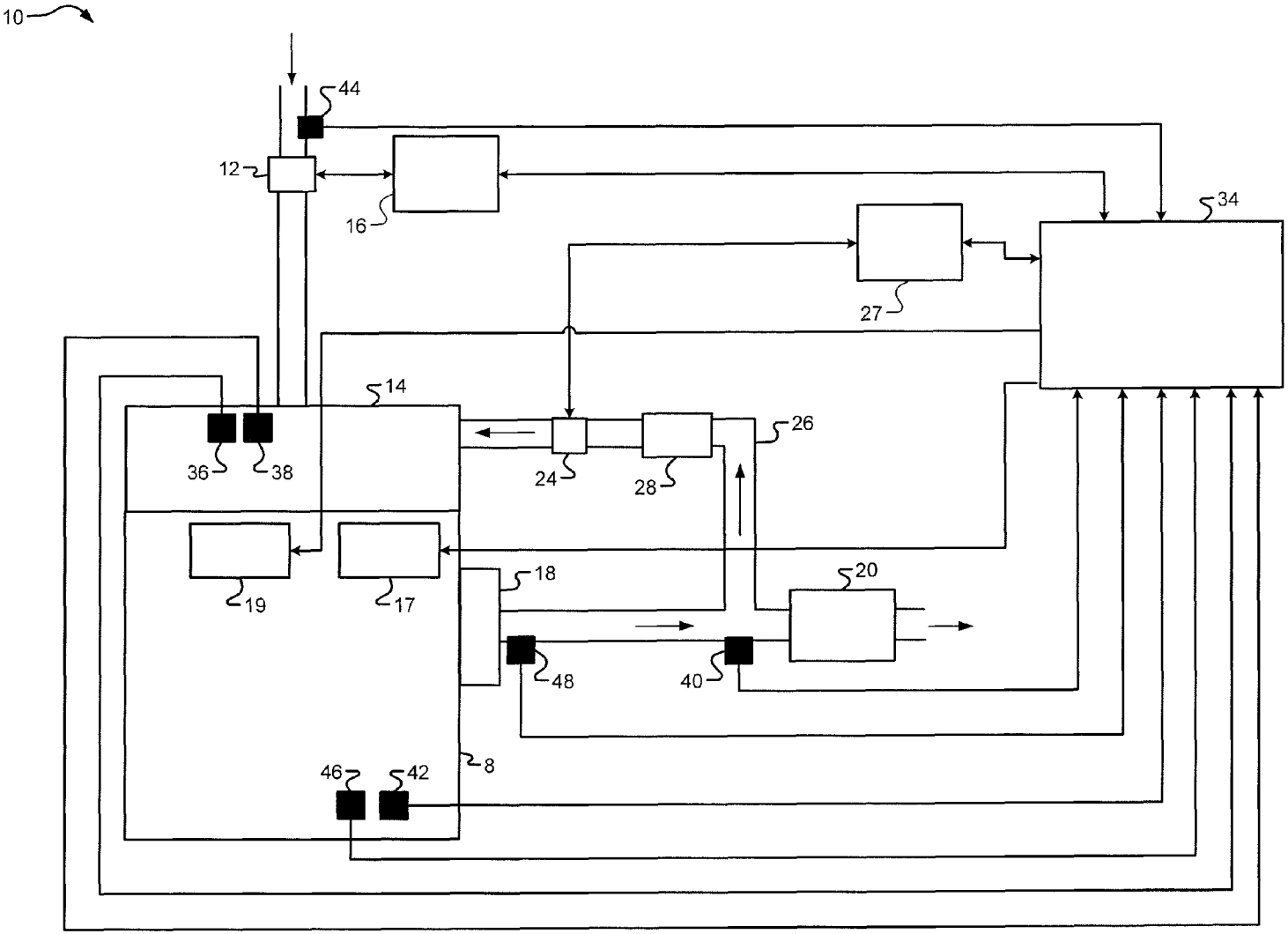

Referring now to FIGS. 1A and 1B, functional block diagrams of examples of an engine system 10 is presented. While the engine system 10 will be discussed in terms of a spark ignition engine system, the present application is also applicable to other types of engine systems including compression ignition engine systems and hybrid engine systems.

Air is drawn into an engine 8 via an intake system. The intake system includes a throttle valve 12 and an intake manifold 14. The throttle valve 12 regulates airflow into the intake manifold 14. A throttle actuator module 16 controls actuation of the throttle valve 12. The engine 8 combusts an air/fuel mixture within cylinders of the engine 8. A fuel system 17 selectively injects fuel into the engine 8. Fuel is provided to the fuel system 17 from a fuel tank (not shown). An ignition system 19 selectively provides spark to the engine 8 for combustion.

Combustion of the air/fuel mixture drives a crankshaft and produces exhaust. The engine 8 outputs the exhaust to an exhaust manifold 18. A catalyst 20 receives the exhaust from the exhaust manifold 18 and reacts with various components of the exhaust. For example only, the catalyst 20 may include a three-way catalyst (TWC), a catalytic converter, or another suitable type of catalyst.

An EGR system selectively recirculates a portion of the exhaust back to the intake system. While recirculation of exhaust back to the intake manifold 14 is shown and will be discussed, exhaust can be recirculated back to other locations in the intake system (including upstream of an intake oxygen sensor, which is introduced below).

The EGR system includes an EGR valve 24 and an EGR conduit 26. Operation of the engine 8 creates a vacuum (low pressure relative to ambient pressure) within the intake manifold 14. Opening the EGR valve 24 allows exhaust to be recirculated back to the intake manifold 14. An EGR actuator module 27 may control actuation of the EGR valve 24.

The EGR system may also include an EGR cooler 28 that cools exhaust as the exhaust flows through the EGR cooler 28 on its way back to the intake manifold 14. In various implementations, the EGR system may further include a cooler bypass system that can be controlled to allow exhaust to bypass the EGR cooler 28. The exhaust may be recirculated back to the intake system from downstream of the catalyst 20 as shown in FIG. 1A. As shown in FIG. 1B, the exhaust may alternatively be recirculated back to the intake system from upstream of the catalyst 20.

While not shown, a fuel vapor purge system collects fuel vapor from the fuel tank. The fuel vapor purge system is controlled to selectively allow vacuum within the intake system to draw collected fuel vapor to the intake system for combustion within the engine 8.

An engine control module (ECM) 34 regulates operation of the engine system 10. For example, the ECM 34 may control opening of the throttle valve 12 via the throttle actuator module 16, opening of the EGR valve 24 via the EGR actuator module 27, fuel injection amount and timing via the fuel system 17, and spark timing via the ignition system 19. The ECM 34 may also control other engine actuators that are not shown including intake and exhaust valve actuators, boost devices (e.g., one or more turbochargers and/or superchargers), and/or one or more other suitable engine actuators.

The ECM 34 communicates with various sensors, such as a manifold absolute pressure (MAP) sensor 36, an intake oxygen (IO) sensor 38, and an exhaust oxygen (EO) sensor 40. The ECM 34 also communicates with an engine speed sensor 42, a mass air flow (MAF) sensor 44, an engine coolant temperature sensor 46, an exhaust temperature sensor 48, and/or one or more other suitable sensors.

The MAP sensor 36 generates a MAP signal indicating an absolute pressure in the intake manifold 14. The engine speed sensor 42 generates a signal based on rotation of the crankshaft. An engine speed, in revolutions per minute (RPM), can be generated based on the rotation of the crankshaft.

The IO sensor 38 generates an IO signal (e.g., current or voltage) that corresponds to a partial pressure of oxygen within the intake manifold 14. The EO sensor 40 generates an EO signal (e.g., current or voltage) that corresponds to a partial pressure of oxygen in the exhaust. The EO sensor 40 is located such that it generates the EO signal based on the exhaust that is recirculated back to the engine 8. For example, the EO sensor 40 is located upstream of the catalyst 20 when the exhaust is recirculated from upstream of the catalyst 20 as shown in FIG. 1A. When the exhaust is recirculated from downstream of the catalyst 20, as shown in FIG. 1B, the EO sensor 40 is located downstream of the catalyst 20.

The IO sensor 38 is a wide-range type oxygen sensor. The EO sensor 40 may also be a wide-range type oxygen sensor. Wide-range oxygen sensors may also be referred to as wide-band oxygen sensors or universal oxygen sensors. A switching type oxygen sensor generates a signal, and switches the signal between a first predetermined value and a second predetermined value when the oxygen concentration is at upper and lower limits, respectively. In contrast with switching type oxygen sensors, wide-range type oxygen sensors vary a signal between first and second predetermined values to provide continuous measurements between upper and lower limits.

The engine coolant temperature sensor 46 generates a coolant temperature signal indicating an engine coolant temperature. The exhaust temperature sensor 48 generates an exhaust temperature signal indicating exhaust temperature prior to the exhaust flowing through the EGR cooler 28 and/or other treatment devices.

The MAF sensor 44 generates a MAF signal indicating mass flow rate of air into the intake manifold 14. The ECM 34 may determine an engine load. For example only, the ECM 34 may determine the engine load based on an engine output torque and/or a fueling rate of the engine 8. The fueling rate may be, for example, an amount (e.g., volume or mass) of fuel per combustion event.

Figure 2:
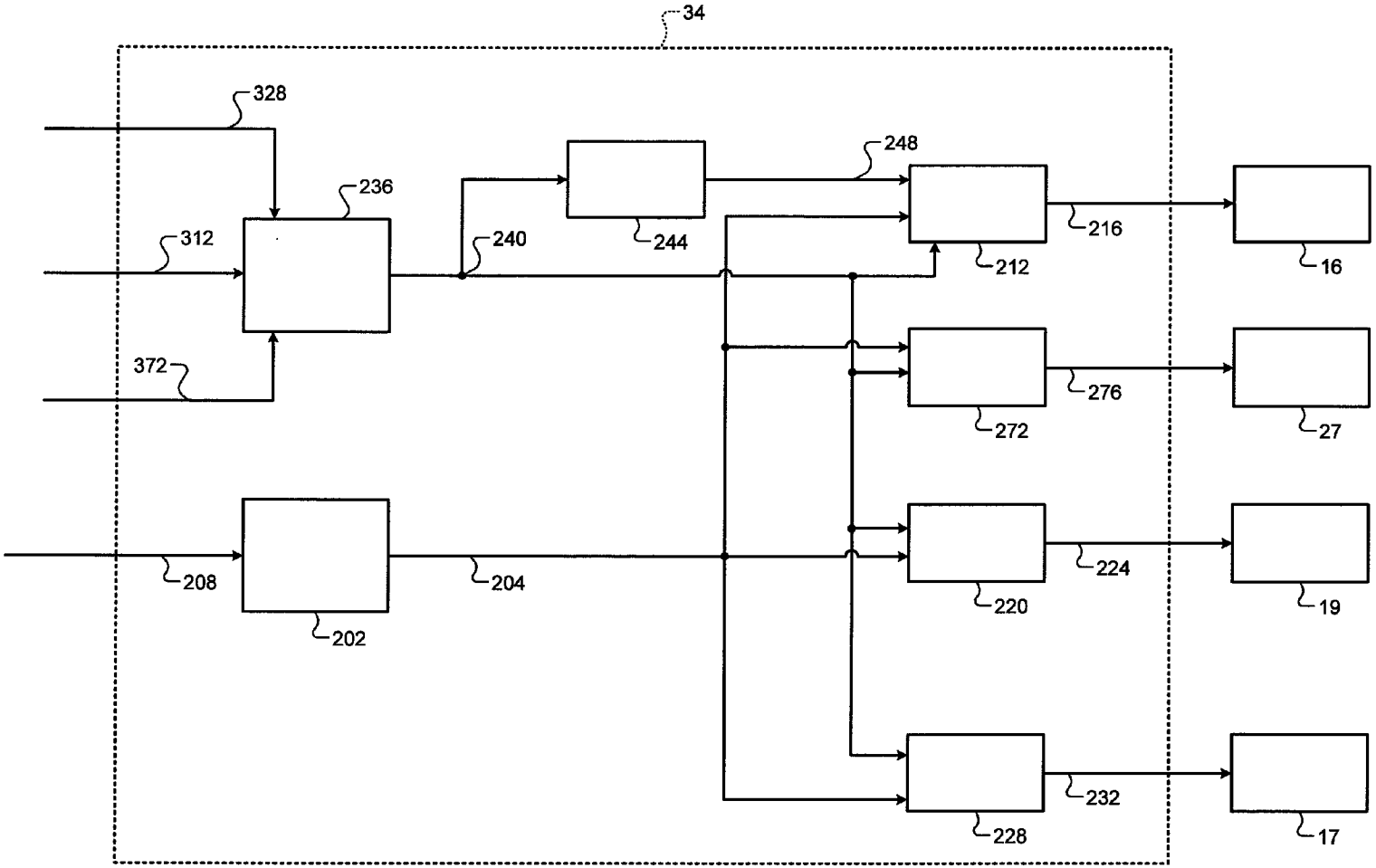
FIG. 2 is a functional block diagram of a portion of an engine control module according to the present disclosure.

Referring now to FIG. 2, a functional block diagram of a portion of an example implementation of the ECM 34 is presented. A driver torque module 202 may determine a driver torque request 204 based on one or more driver inputs 208, such as an accelerator pedal position, a brake pedal position, a cruise control input, and/or one or more other suitable driver inputs. One or more engine operating parameters may be controlled based on the driver torque request 204 and/or one or more other torque requests.

For example, a throttle control module 212 may determine a desired throttle opening 216 based on the driver torque request 204. The throttle actuator module 16 may adjust opening of the throttle valve 12 based on the desired throttle opening 216. A spark control module 220 may determine a desired spark timing 224 based on the driver torque request 204. The ignition system 19 may generate spark based on the desired spark timing 224. A fuel control module 228 may determine one or more desired fueling parameters 232 based on the driver torque request 204. For example, the desired fueling parameters 232 may include fuel injection timing and amount. The fuel system 17 may inject fuel based on the desired fueling parameters 232. An EGR control module 272 may determine a desired EGR valve opening 276 based on the driver torque request 204.

The EGR actuator module 27 may regulate opening of the EGR valve 24 based on the desired EGR valve opening 276.

Figure 3:
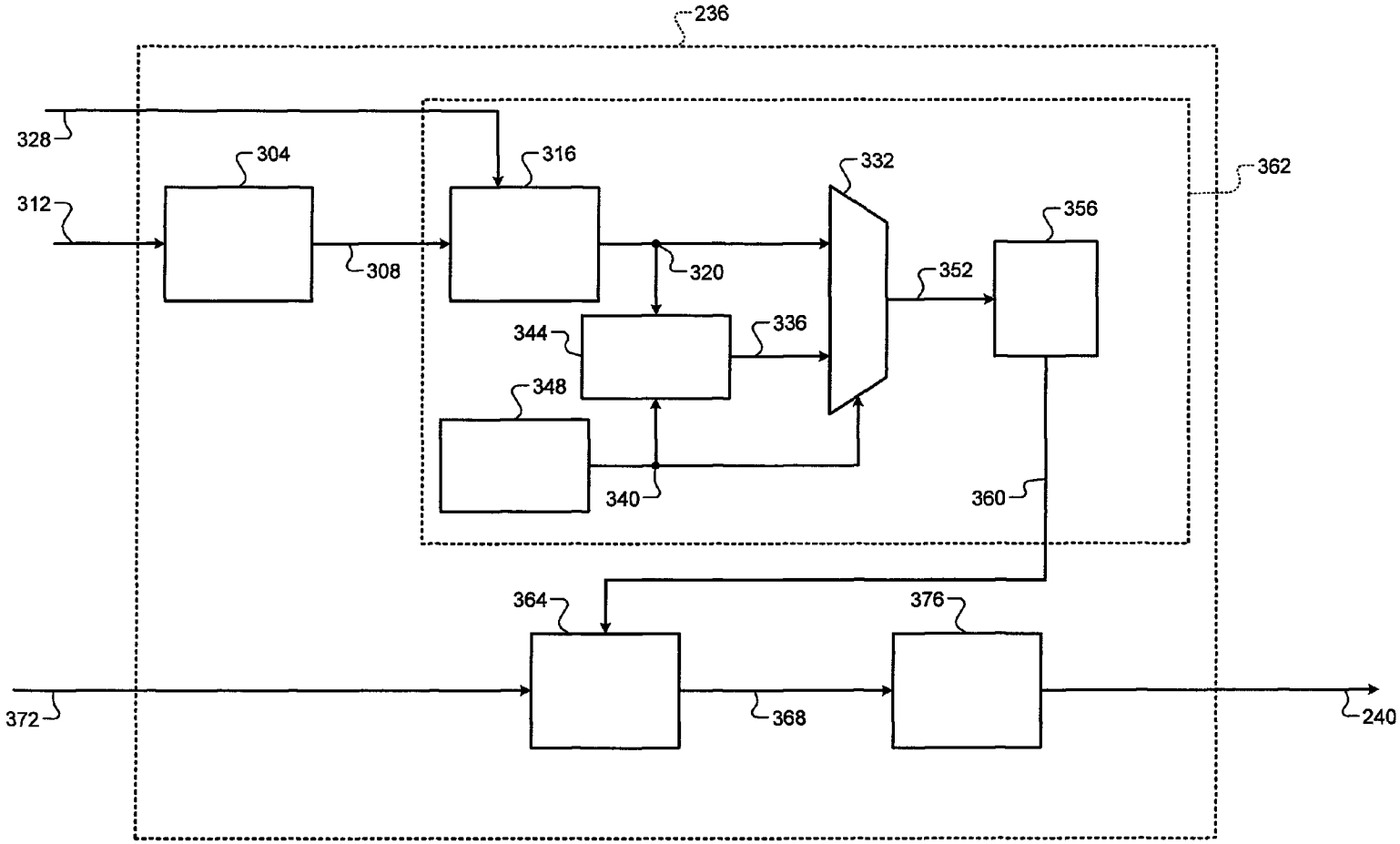
FIG. 3 is functional block diagram of an oxygen per cylinder module according to the present disclosure.

The ECM 34 may include an oxygen determination module 236 (see also FIG. 3). Humidity in the air flowing into the engine 8 may affect performance of the engine 8. Because oxygen ($O_2$) molecules are heavier than water vapor molecules, water vapor molecules in the air flowing into the engine 8 displace oxygen molecules. The amount of oxygen within a cylinder during a combustion event affects performance of the engine 8. Ambient humidity could be measured using a humidity sensor. However, addition of a humidity sensor may increase vehicle cost.

The oxygen determination module 236 determines an amount (e.g., mass) of oxygen ($O_2$) that will be present for each combustion event of the engine 8. This amount will be referred to as oxygen per cylinder (OPC) 240. In contrast with the OPC 240, which varies with ambient humidity, air per cylinder (APC) does not vary with humidity. As IO concentration determined based on measurements of the IO sensor 38 are affected by ambient humidity, the oxygen determination module 236 determines the OPC 240 based on the IO concentration.

One or more engine operating parameters may be controlled or adjusted based on the OPC 240. For example, the fuel control module 228 may command fuel injection to produce a desired (e.g., stoichiometric) air/fuel mixture with the OPC 240. A torque estimation module 244 may estimate a torque output of the engine 8. The estimated torque output of the engine 8 will be referred to as an estimated torque 248. The throttle control module 212 may use the estimated torque 248 to perform closed-loop control of one or more engine air flow parameters, such as throttle area, MAP, and/or one or more other suitable air flow parameters. The throttle control module 212 may adjust the desired throttle opening 216 based on the estimated torque 248.

The torque estimation module 244 may determine the estimated torque 248 using a torque relationship. For example, the torque estimation module 244 may determine the estimated torque 248 using the relationship:

$$T=f(\mathrm{OPC},S,I,E,\mathrm{AF},\mathrm{OT},\#,\mathrm{EGR}), \quad (1)$$

where torque (T) is the estimated torque 248 and is a function of the oxygen per cylinder (OPC) 240, spark advance/timing (S), intake opening timing and duration (I), exhaust opening timing and duration (E), air/fuel ratio (AF), oil temperature (OT), number of activated cylinders (#), and EGR mass flow rate (EGR). This relationship may be modeled by an equation and/or may be stored in the form of a mapping (e.g., look up table).

The spark control module 220 may determine the desired spark timing 224 using a spark relationship. The spark relationship may be based on the torque relationship above, inverted to solve for desired spark timing. For example only, for a given torque request ($T_{des}$), the spark control module 220 may determine the desired spark timing 224 using a spark relationship:

$$S_{des}=f^{-1}(T_{des},\mathrm{OPC},I,E,\mathrm{AF},\mathrm{OT},\#,\mathrm{EGR}). \quad (2)$$

The spark relationship may be embodied as an equation and/or as a lookup table. The air/fuel ratio (AF) may be the actual air/fuel ratio, for example, as reported by the fuel control module 228. One or more other engine operating parameters may additionally or alternatively be controlled based on the OPC 240.

Referring now to FIG. 3, a functional block diagram of an example implementation of the oxygen determination module 236 is presented. A partial pressure determination module 304 may determine an intake oxygen (IO) partial pressure 308 (e.g., in Pascal or Pa) based on the IO signal 312 generated by the IO sensor 38.

The IO signal 312 may be based on current flow through the IO sensor 38. The current through the IO sensor 38 may be referred to as a pumping current. The partial pressure determination module 304 determines the IO partial pressure 308 as a function of the IO signal 312. The partial pressure determination module 304 may determine the IO partial pressure 308 using a relationship that relates the IO signal 312 to the IO partial pressure 308. The relationship may be embodied as an equation or as a lookup table.

A concentration determination module 316 determines an IO concentration 320 based on the IO partial pressure 308. The IO concentration 320 may be expressed as a percentage (by volume) of oxygen in the gas (air and/or exhaust) present at the location of the IO sensor 38. For example only, ideal dry air may have a percentage of oxygen by volume of approximately 20.9%. The percentage of oxygen by volume of air may be a value between approximately 19.5 and approximately 20.9 depending on humidity, ambient pressure, and ambient temperature conditions.

The concentration determination module 316 determines the IO concentration 320 as a function of the IO partial pressure 308. The concentration determination module 316 may determine the IO concentration 320 using a relationship that relates the IO partial pressure 308 to the IO concentration 320. The relationship may be embodied as an equation or a lookup table.

The concentration determination module 316 may also correct the IO concentration 320 to compensate for a MAP 328 measured using the MAP sensor 36. For example only, the concentration determination module 316 may determine the IO concentration 320 using one or more functions and/or tables that relate the IO partial pressure 308 and the MAP 328 to the IO concentration 320.

In various implementations, the concentration determination module 316 may determine a correction (not shown) based on the MAP 328 and determine an uncompensated IO concentration (not shown) based on the IO partial pressure 308. The concentration determination module 316 may determine the uncompensated IO concentration, for example, using one or more functions or tables that relate the IO partial pressure 308 to the uncompensated IO concentration. The concentration determination module 316 may determine the correction, for example, using one or more functions or tables that relate the MAP 328 to the correction. The concentration determination module 316 may determine the IO concentration 320 based on the correction and the uncompensated IP concentration. The concentration determination module 316 may, for example, set the IO concentration 320 equal to one of a product and a sum of: the uncompensated IO concentration; and the correction.

A selecting module 332 selects one of the IO concentration 320 and a stored IO concentration 336 based on a state of a selection signal 340. The selecting module 332 may, for example, select the IO concentration 320 when the selection signal 340 is in a first state and select the stored IO concentration 336 when the selection signal 340 is in a second state.

A storage module 344 outputs the stored IO concentration 336. The storage module 344 selectively updates the stored IO concentration 336 to the IO concentration 320 based on the state of the selection signal 340. For example, the storage module 344 sets the stored IO concentration 336 equal to the IO concentration 320 when the selection signal 340 is in the first state. When the selection signal 340 is in the second state, the storage module 344 may maintain the stored IO concentration 336 and not set the stored IO concentration 336 equal to the IO concentration 320.

A selection control module 348 generates the selection signal 340. The selection control module 348 may generate the selection signal 340, for example, based on a EGR flow, fuel vapor flow, and/or exhaust blow-by conditions. The selection control module 348 may, for example, set the selection signal 340 to the first state when EGR flow to the intake system is zero (e.g., when the EGR valve 24 is closed), fuel vapor flow to the intake system is zero (e.g., a fuel vapor purge valve is closed), and exhaust blow-by is low. The selection control module 348 may set the selection signal to the second state when at least one of: EGR flow to the intake system is greater than zero; fuel vapor flow to the intake system is greater than zero; and exhaust blow-by is not low. Exhaust blow-by may be deemed low, for example, when the MAP 328 or the engine load is greater than a predetermined value.

In this manner, the IO concentration 320 is selected and the stored IO concentration 336 is updated to the IO concentration 320 when EGR flow to the intake system is zero, fuel vapor flow to the intake system is zero, and exhaust blow-by is low. Additionally, the stored IO concentration 336 is selected and not updated when at least one of: EGR flow to the intake system is greater than zero; fuel vapor flow to the intake system is greater than zero; and exhaust blow-by is not low.

The selecting module 332 outputs the selected one of the IO concentration 320 and the stored IO concentration 336 as a selected IO concentration 352. A rate limiting module 356 may be implemented to rate limit changes in the selected IO concentration 352. The rate limiting module 356 outputs a rate limited version of the selected IO concentration 352, which will be referred to as present IO concentration 360. To apply the rate limit, the rate limiting module 356 may adjust the present IO concentration 360 toward the selected IO concentration 352 by up to a predetermined amount per predetermined period. A concentration module 364 may include the concentration determination module 316, the selecting module 332, the storage module 344, the selection control module 348, and the rate limiting module 356.

An oxygen mass flow rate module 364 determines a mass flow rate of oxygen flowing into the engine 8 (e.g., mass of oxygen per unit of time). The mass flow rate of oxygen flowing into the engine 8 will be referred to as oxygen mass flow rate 368. The oxygen mass flow rate module 364 determines the oxygen mass flow rate 368 based on a MAF (mass air flow rate) 372 measured using the MAF sensor 44 and the present IO concentration 360. The oxygen mass flow rate module 364 may determine the oxygen mass flow rate 368 as a function of the MAF 372 and the present IO concentration 360. The function may be embodied as one or more equations and/or a lookup tables. For example only, the oxygen mass flow rate module 364 may set the oxygen mass flow rate 368 equal to a product of the MAF 372 and the present IO concentration 360.

An oxygen per cylinder module 376 determines the OPC 240 (e.g., in grams) based on the oxygen mass flow rate 368. The oxygen per cylinder module 376 determines the OPC 240 as a function of the oxygen mass flow rate 368. As stated above, the OPC 240 can be used to control or adjust one or more engine operating parameters.

Figure 4:
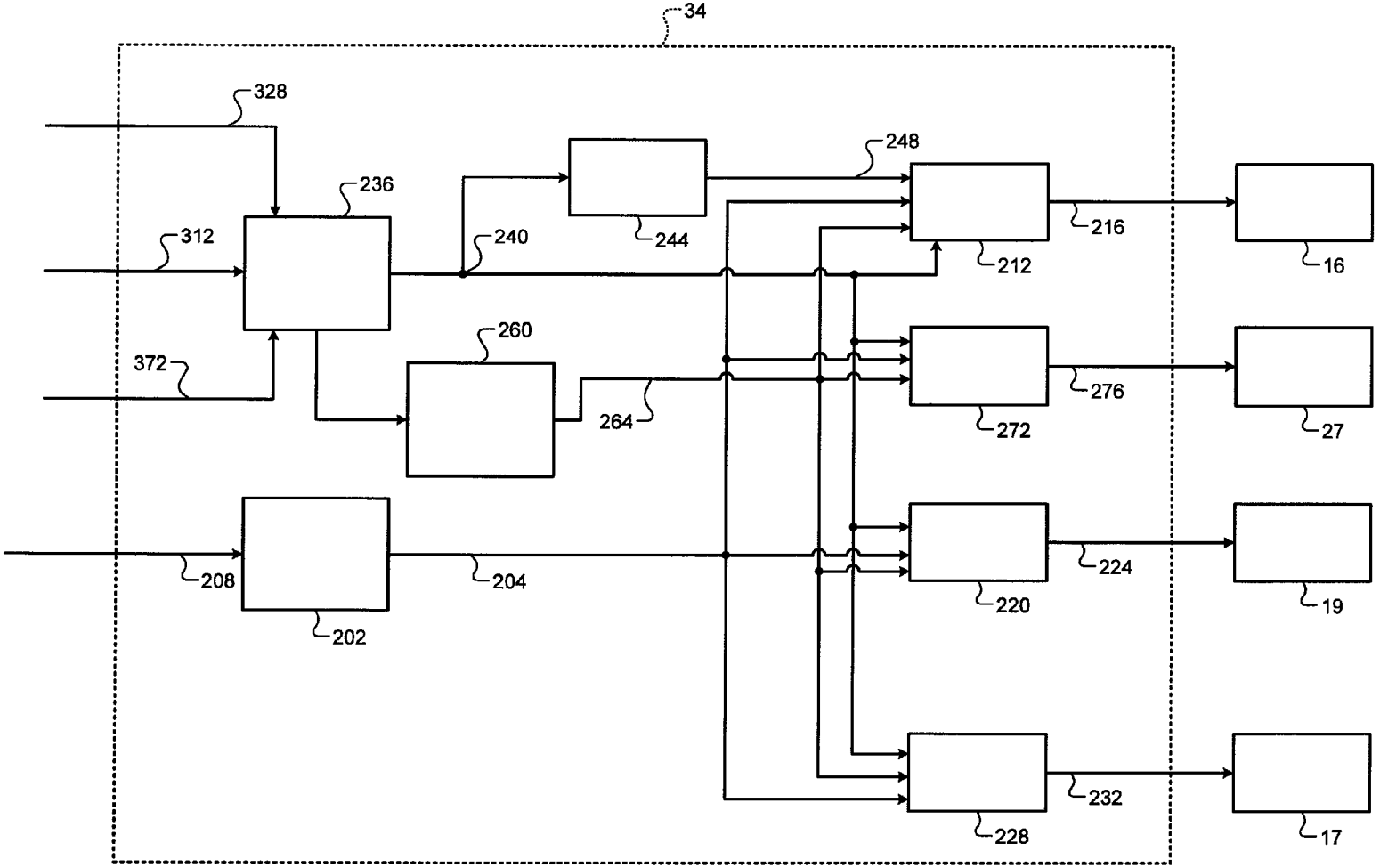
FIG. 4 is another functional block diagram of a portion of the engine control module according to the present disclosure.

Referring now to FIG. 4, another functional block diagram of a portion of an example implementation of the ECM 34 is presented. In various implementations, a humidity determination module 260 may be implemented to determine a relative humidity 264 of the air flowing into the engine 8. As stated above, a humidity sensor is not included. One or more engine operating parameters can be controlled or adjusted based on the relative humidity 264.

The humidity determination module 260 determines the relative humidity 264 based on the measurements of the IO sensor 38. The humidity determination module 260 may determine the relative humidity 264 using the equation:

$$RH = \frac{P_{Air}}{VP_{Sat}}\left(1 - \frac{O_{2Air}}{20.95}\right) * 100, \tag{3}$$

where RH is relative humidity (expressed as a percentage), $P_{Air}$ is ambient (barometric) air pressure, $O_{2Air}$ is an IO concentration determined based on measurements of the IO sensor 38, and $VP_{sat}$ is determined using the equation:

$$VP_{Sat} = \frac{10^{\left(8.07131 - \left(\frac{1730.63}{233.426 + T_{Air}}\right)\right)}}{7.500617}, \tag{4}$$

where $T_{Air}$ is ambient air temperature. Ambient pressure and temperature may be measured using ambient pressure and temperature sensors, determined based on one or more other measured parameters, or obtained in another suitable manner. The IO concentration ($O_{2Air}$) may be, for example, the present IO concentration 360 or another suitable IO concentration.

In various implementations, the humidity determination module 260 may determine the relative humidity 264 based on the relationship:

$$p_{Air}MW_{Air} = p_{O_2}MW_{O_2} + p_{N_2}MW_{N_2} + p_{H_2O}MW_{H_2O} \tag{5}$$

where $p_{Air}$ is ambient air pressure, $MW_{Air}$ is the molecular weight of ambient air, $p_{O2}$ is the partial pressure of oxygen of the ambient air, $M_{WO2}$ is the molecular weight of oxygen, $p_{N2}$ is the partial pressure of nitrogen ($N_2$) of the ambient air, $p_{H2O}$ is the partial pressure of water vapor of the ambient air, and $MW_{H2O}$ is the molecular weight of water. The molecular weights of oxygen, nitrogen, and water are 32, 28, and 18, respectively. It is known that:

$$\frac{p_{N_2}}{p_{O_2}} = \frac{m_{N_2} * MW_{N_2}}{m_{O_2} * MW_{O_2}} = 3.773, \tag{6}$$

where $m_{N2}$ is the mass of nitrogen and $m_{O2}$ is the mass of oxygen. The following equation can be derived based on equations (5), (6), and the molecular weights of oxygen, nitrogen, and water:

$$p_{Air} = 4.763 * p_{O_2} + 0.6228 * p_{H_2O}. \tag{7}$$

Equation (7) can be re-written to solve for the partial pressure of water vapor of the ambient air as:

$$p_{H_20} = \frac{p_{Air} - 4.763 * p_{O_2}}{0.6228}. \tag{8}$$

The IO partial pressure 308 or another suitable IO partial pressure may be used as the partial pressure of oxygen ($p_{O2}$). Ambient (barometric) pressure ($P_{Air}$) may be measured using an ambient pressure sensor, determined based on one or more other measured parameters, or obtained in another suitable manner. The humidity determination module 260 may determine the relative humidity 264 as a function of the partial pressure of water vapor in the ambient air ($p_{H2O}$). One or more engine operating parameters may be controlled or adjusted based on the relative humidity 264.

Figure 5:
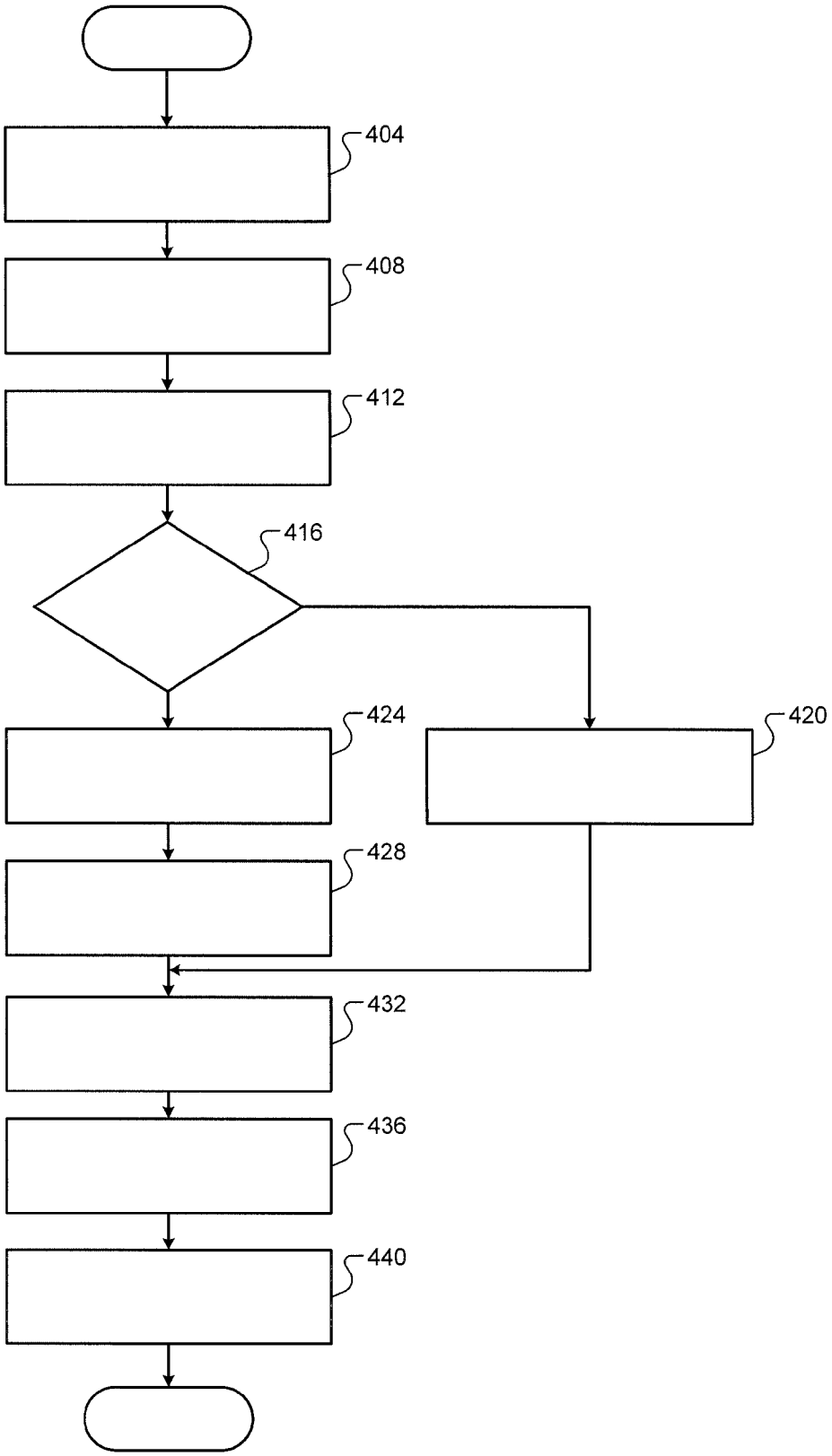
FIG. 5 is a flowchart depicting an example method of determining oxygen per cylinder based on ambient humidity without using a humidity sensor according to the present disclosure.

Referring now to FIG. 5, a flowchart depicting an example method of determining the OPC 240 based on ambient humidity without using a humidity sensor according to the present disclosure. Control may begin with 404 where control receives the IO signal 312 from the IO sensor 37. At 408, control determines the IO partial pressure 308 based on the IO signal 312.

At 412, control determines the IO concentration 320 based on the IO partial pressure 308. Control may also adjust the IO concentration 320 or determine the IO concentration 320 based on the MAP 328. Control may determine whether one or more enabling conditions are satisfied at 416. For example, control may determine whether EGR flow to the intake system is zero, fuel vapor flow to the intake system is zero, and exhaust blow-by is low at 416. If one or more of the above are false, control may maintain (i.e., not update) the stored IO concentration 336 and select the stored IO concentration 336 at 420, and control may continue with 432. If all of the above are true, control may update the stored IO concentration 336 to the IO concentration 320 at 424 and select the IO concentration 320 at 428, and control may continue with 432.

At 432, control generates the present IO concentration 360 based on the selected one of the IO concentration 320 and the stored IO concentration 336. For example, control may adjust the present IO concentration 360 toward the selected one of the IO concentration 320 and the stored IO concentration 336 by up to a predetermined amount to rate limit changes in the present IO concentration 360.

Control determines the oxygen mass flow rate 368 at 436. Control determines the oxygen mass flow rate 368 based on the present IO concentration 360 and the MAF 372. For example, control may set the oxygen mass flow rate 368 equal to the product of the present IO concentration 360 and the MAF 372. Control determines the OPC 240 at 440 based on the oxygen mass flow rate 368. Control may control or adjust one or more engine operating parameters based on the OPC 240. For example, control may adjust fueling for a combustion event of a cylinder based on the OPC 240 for the combustion event of the cylinder to achieve a desired air/fuel mixture. While control is shown as ending after 440, FIG. 4 may be illustrative of one control loop.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. For purposes of clarity, the same reference numbers will be used in the drawings to identify similar elements. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

As used herein, the term module may refer to, be part of, or include an Application Specific Integrated Circuit (ASIC); an electronic circuit; a combinational logic circuit; a field programmable gate array (FPGA); a processor (shared, dedicated, or group) that executes code; other suitable hardware components that provide the described functionality; or a combination of some or all of the above, such as in a system-on-chip. The term module may include memory (shared, dedicated, or group) that stores code executed by the processor.

The term code, as used above, may include software, firmware, and/or microcode, and may refer to programs, routines, functions, classes, and/or objects. The term shared, as used above, means that some or all code from multiple modules may be executed using a single (shared) processor. In addition, some or all code from multiple modules may be stored by a single (shared) memory. The term group, as used above, means that some or all code from a single module may be executed using a group of processors. In addition, some or all code from a single module may be stored using a group of memories.

The apparatuses and methods described herein may be implemented by one or more computer programs executed by one or more processors. The computer programs include processor-executable instructions that are stored on a non-transitory tangible computer readable medium. The computer programs may also include stored data. Non-limiting examples of the non-transitory tangible computer readable medium are nonvolatile memory, magnetic storage, and optical storage.

What is claimed is:

1. An engine control system for a vehicle, comprising:

an oxygen mass flow rate module that generates a mass flow rate of oxygen flowing into an engine based on a mass air flow rate (MAF) into the engine and a percentage of oxygen by volume measured using an intake oxygen (IO) sensor in an intake system;

an oxygen per cylinder module that generates a mass of oxygen for a combustion event of a cylinder of the engine based on the mass flow rate of oxygen flowing into the engine; and a fuel control module that controls fueling to the cylinder for the combustion event based on the mass of oxygen.

2. The engine control system of claim 1 further comprising:

a partial pressure module that receives an IO signal from the IO sensor and that determines a partial pressure of oxygen in the intake system based on the IO signal; and a concentration module that determines a second percentage of oxygen by volume in the intake system based on the partial pressure of oxygen and that, based on at least one of a flow rate of exhaust gas recirculation (EGR) to the intake system, a flow rate of fuel vapor to the intake system, and a manifold pressure, selectively sets the percentage of oxygen equal to one of the second percentage of oxygen and a stored value of the second percentage of oxygen.

3. The engine control system of claim 2 wherein the concentration module:

sets the percentage of oxygen equal to the second percentage of oxygen when the flow rate of EGR is zero, the flow rate of fuel vapor is zero, and the manifold pressure is greater than a predetermined pressure; and sets the percentage of oxygen equal to the stored value of the second percentage of oxygen when at least one of the flow rate of EGR is greater than zero, the flow rate of fuel vapor is greater than zero, and the manifold pressure is less than the predetermined pressure.

4. The engine control system of claim 1 wherein the oxygen mass flow rate module generates the mass flow rate of oxygen as a function of the MAF and the percentage of oxygen.

5. The engine control system of claim 1 wherein the oxygen mass flow rate module sets the mass flow rate of oxygen equal to a product of the MAF and the percentage of oxygen.

6. The engine control system of claim 1 wherein the oxygen per cylinder module generates the mass of oxygen as a function of the mass flow rate of oxygen.

7. The engine control system of claim 1 further comprising:

a partial pressure module that receives an IO signal from the IO sensor and that determines a partial pressure of oxygen in the intake system based on the IO signal; and a concentration determination module that determines the percentage of oxygen based on the partial pressure of oxygen.

8. The engine control system of claim 7 wherein the concentration determination module determines the percentage of oxygen as a function of the partial pressure of oxygen.

9. The engine control system of claim 8 wherein the concentration determination module determines the percentage of oxygen further based on a manifold pressure.

10. The engine control system of claim 1 further comprising a humidity determination module that determines a relative humidity of air flowing into the engine as a function of the percentage of oxygen.

11. An engine control method for a vehicle, comprising:

generating a mass flow rate of oxygen flowing into an engine based on a mass air flow rate (MAF) into the engine and a percentage of oxygen by volume measured using an intake oxygen (IO) sensor in an intake system;

generating a mass of oxygen for a combustion event of a cylinder of the engine based on the mass flow rate of oxygen flowing into the engine; and controlling fueling to the cylinder for the combustion event based on the mass of oxygen.

12. The engine control method of claim 11 further comprising:

receiving an IO signal from the IO sensor;

determining a partial pressure of oxygen in the intake system based on the IO signal;

determining a second percentage of oxygen by volume in the intake system based on the partial pressure of oxygen; and, based on at least one of a flow rate of exhaust gas recirculation (EGR) to the intake system, a flow rate of fuel vapor to the intake system, and a manifold pressure, selectively setting the percentage of oxygen equal to one of the second percentage of oxygen and a stored value of the second percentage of oxygen.

13. The engine control method of claim 12 further comprising:

setting the percentage of oxygen equal to the second percentage of oxygen when the flow rate of EGR is zero, the flow rate of fuel vapor is zero, and the manifold pressure is greater than a predetermined pressure; and setting the percentage of oxygen equal to the stored value of the second percentage of oxygen when at least one of the flow rate of EGR is greater than zero, the flow rate of fuel vapor is greater than zero, and the manifold pressure is less than the predetermined pressure.

14. The engine control method of claim 11 further comprising generating the mass flow rate of oxygen as a function of the MAF and the percentage of oxygen.

15. The engine control method of claim 11 further comprising setting the mass flow rate of oxygen equal to a product of the MAF and the percentage of oxygen.

16. The engine control method of claim 11 further comprising generating the mass of oxygen as a function of the mass flow rate of oxygen.

17. The engine control method of claim 11 further comprising:

receiving an IO signal from the IO sensor;

determining a partial pressure of oxygen in the intake system based on the IO signal; and determining the percentage of oxygen based on the partial pressure of oxygen.

18. The engine control method of claim 17 further comprising determining the percentage of oxygen as a function of the partial pressure of oxygen.

19. The engine control method of claim 18 further comprising determining the percentage of oxygen further based on a manifold pressure.

20. The engine control method of claim 11 further comprising determining a relative humidity of air flowing into the engine as a function of the percentage of oxygen.

* * * * *